United States Patent [19]

Cardis et al.

[11] Patent Number: 4,934,867

[45] Date of Patent: Jun. 19, 1990

[54] SEALING DEVICE ENSURING LATERAL TIGHTNESS OF A WEIR GATE

[75] Inventors: Michel Cardis; Bruno Basset, both of Grenoble, France

[73] Assignee: Neyrpic, Grenoble, France

[21] Appl. No.: 332,044

[22] Filed: Apr. 3, 1989

[30] Foreign Application Priority Data

Apr. 25, 1988 [FR] France ..... 88 05721

[51] Int. Cl.[5] ..... E02B 7/54

[52] U.S. Cl. ..... 405/87; 405/101

[58] Field of Search ..... 405/87, 99–105; 251/301, 326, 328

[56] References Cited

U.S. PATENT DOCUMENTS 2,683,354 7/1954 Harza ..... 405/104

3,326,002 6/1967 Halpenny ..... 405/105

3,693,356 9/1972 Mayo et al. ..... 405/100

4,582,451 4/1986 Hollander ..... 405/105

*Primary Examiner*—David H. Corbin

*Attorney, Agent, or Firm*—Dowell & Dowell

[57] ABSTRACT

This invention relates to a sealing device ensuring lateral tightness of a weir gate with respect to the corresponding lock wall, of the type comprising a lip disposed over the whole length of each lateral face of the gate and a rounded rib extending the leading face of said gate, wherein the rounded rib projects transversely beyond the plane of the lock wall, so that its periphery, which takes a circular form, comes into abutment against the lateral face of a cylindrical chamber made in the lock wall. In this way, the displacements of the gate do not affect tightness.

5 Claims, 5 Drawing Sheets

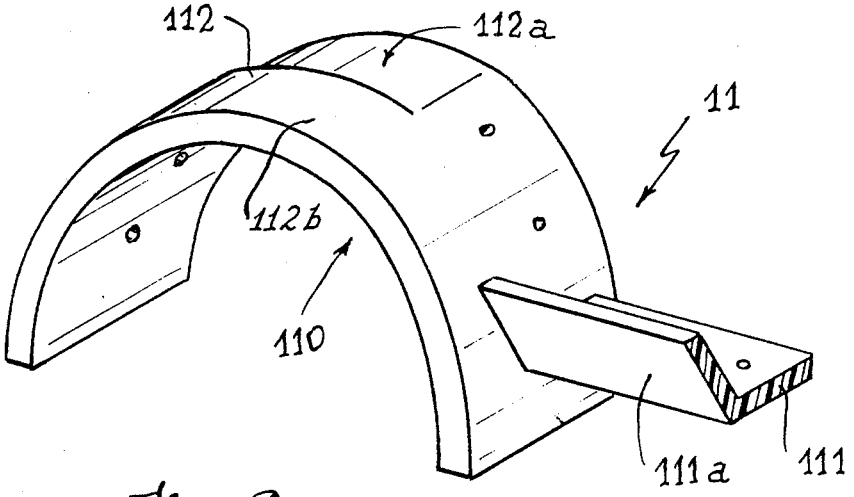
Fig. 6
Fig. 8
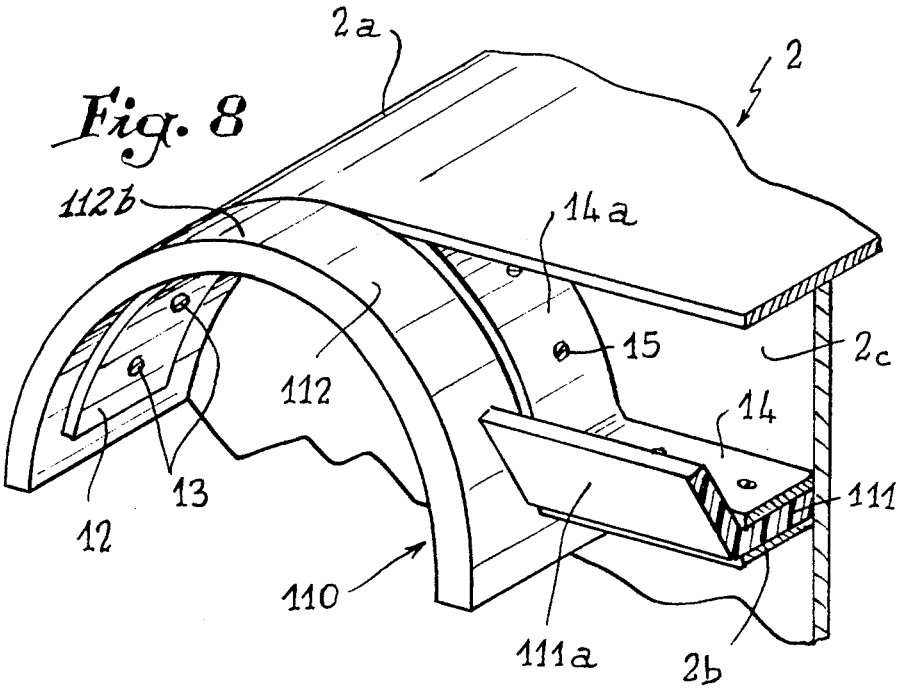

SEALING DEVICE ENSURING LATERAL TIGHTNESS OF A WEIR GATE

FIELD OF THE INVENTION

The present invention relates to a sealing device ensuring lateral tightness of the gate of a weir.

BACKGROUND OF THE INVENTION

It is known that, in the domain of river weirs, gates are used in certain cases and particularly for surface works, which are adapted to regulate the flow or level of the water with a view to constituting movable weirs par excellence. Such a gate is an element presenting, in transverse section, the approximate shape of an aeroplane wing and which pivots longitudinally in order either to allow the water to pass when it is oriented horizontally, or to retain it when it is raised vertically or obliquely. The gates in question comprise a longitudinal sealing device fixed to the sill of the weir, of which the lip cooperates with the leading edge or face of the gate. On either side of the latter is provided a sealing device which ensures lateral tightness with the corresponding lock wall. Each sealing device comprises a lip disposed over the whole length of each lateral face of the gate and a rounded rib corresponding to the leading edge or face and which in fact extends it so as to abut by its lateral edge against the lock wall.

As the gates in question may attain very considerable lengths, of the order of 40 or 50 m, it goes without saying that the expansions or contractions that they undergo during temperature variations cause problems of tightness due to the contractions and problems of clamping of the two sealing devices against the lock walls, due to the expansions. During uses, such clamping provokes wear and tear of the rounded rib of each sealing device, so that leakages can be expected. The problem is, of course, not raised at the lip of the sealing device in question, since said lip is supple.

It is an object of the improvements according to the present invention to overcome these drawbacks and to provide a sealing device intended for the lateral tightness of a weir gate, whose efficiency is independent of the expansions or contractions thereof.

SUMMARY OF THE INVENTION

To that end, the sealing device according to the invention comprises a rounded rib which projects transversely beyond the plane containing the terminal edge of the lip, so that its periphery, which takes a circular form, comes into tight abutment against the lateral face of a cylindrical chamber made in the lock wall.

The rounded rib partly engages beneath the corresponding end of the leading face and extends therebeyond, being flush with the lateral face of the leading face.

BRIEF DESCRIPTION OF THE DRAWINGS

The invention will be more readily understood on reading the following description with reference to the accompanying drawings, in which:

FIG. 6 illustrates in perspective the front part of a sealing device according to the invention.

FIG. 8 shows in perspective the assembly of the sealing device of FIG. 6.

DETAILED DESCRIPTION OF THE DRAWINGS

Figure 1:
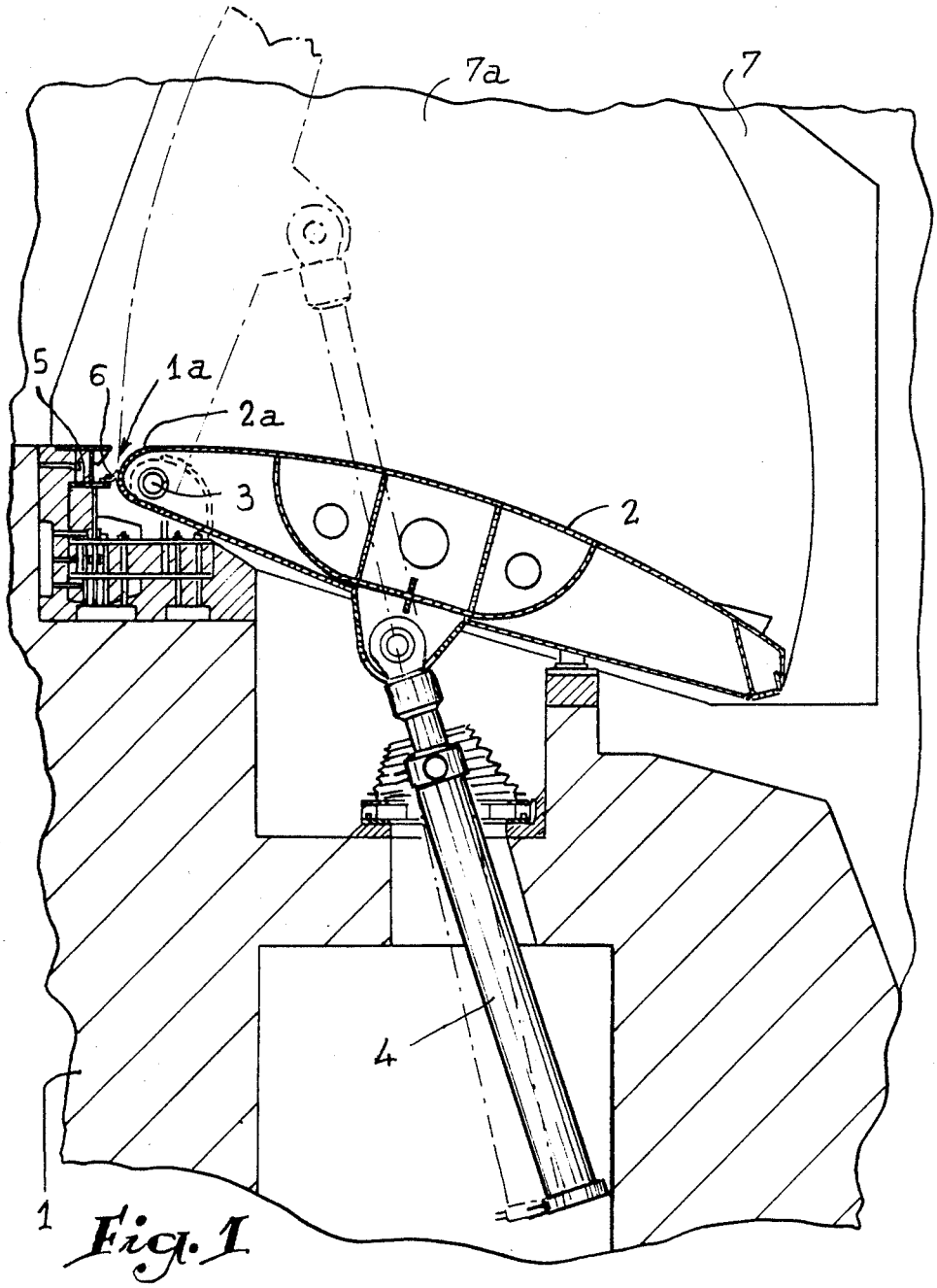
Fig. 1 PRIOR ART
FIG. 1 is a transverse section through a weir equipped with a gate.
Figure 2:
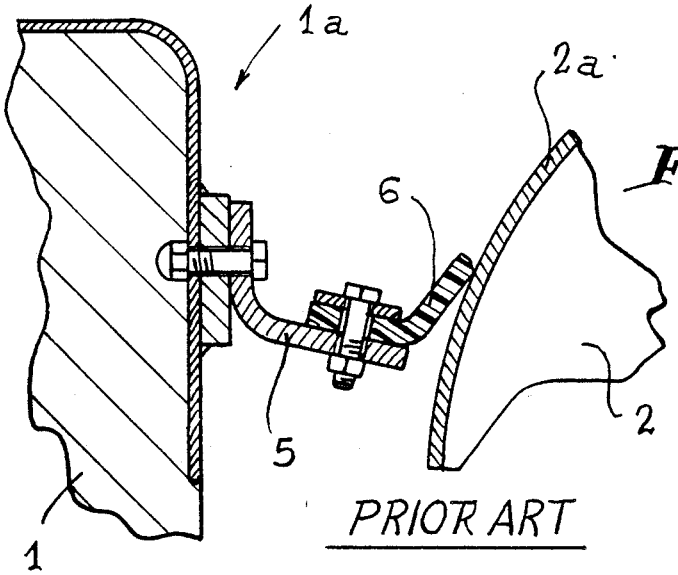
Fig. 2 PRIOR ART
FIG. 2 illustrates in transverse section the conventional longitudinal sealing device cooperating with the leading face of the gate.

Referring now to the drawings, FIG. 1 shows the concrete sill 1 of a weir with respect to which is mounted a gate 2 made in conventional manner in the form of a caisson presenting in transverse section the rough shape of an aeroplane wing. This gate is articulated about a shaft 3 extending along the sill 1 and of which the pivoting movement is controlled by a hydraulic jack 4. The gate may take the position illustrated in solid lines, extending the sill 1 to allow the upstream-downstream passage of the water. By extending the jack 4, the gate 2 is placed in the position illustrated in discontinous lines for which it is substantially vertical in a position retaining the water. Part 2*a* of the gate which surrounds the shaft 3 is conventionally known as the leading edge or face. The sill naturally presents a shoulder 1*a* allowing clearance for the leading face 2*a*. In this shoulder is provided a profile or flange 5 (FIG. 2) fixed to the vertical part of the shoulder 1*a* and to which is fastened a sealing device 6 of which the free end cooperates with the leading face 2*a* in order to ensure tightness or sealing in the longitudinal direction.

Figure 3:
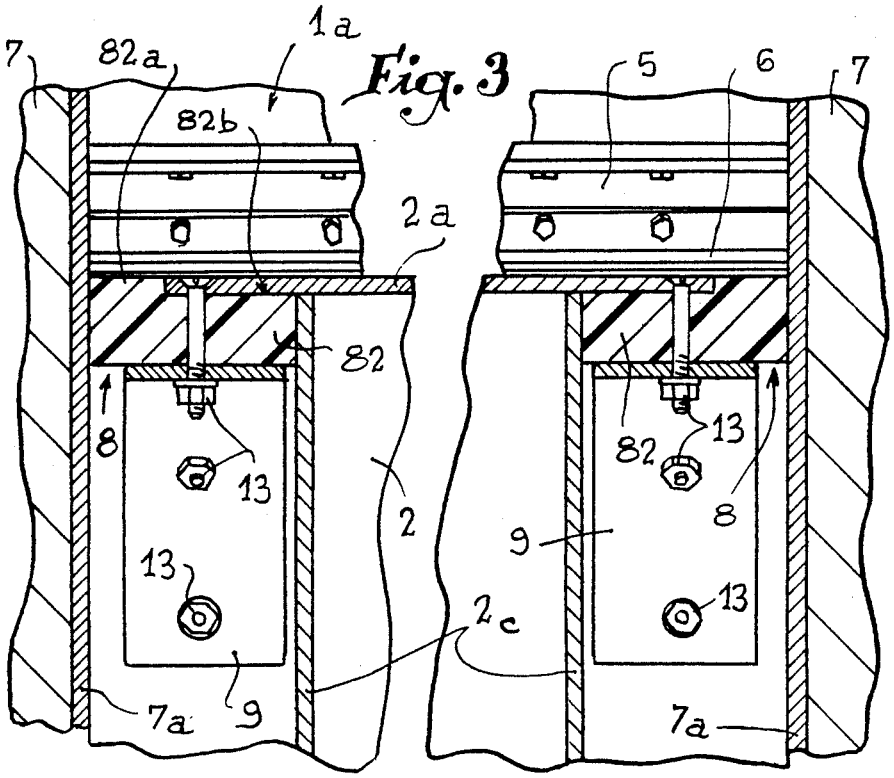
Fig. 3 PRIOR ART
FIG. 3 is a broken longitudinal section of a gate comprising a known sealing device on each of its lateral faces.
Figure 4:
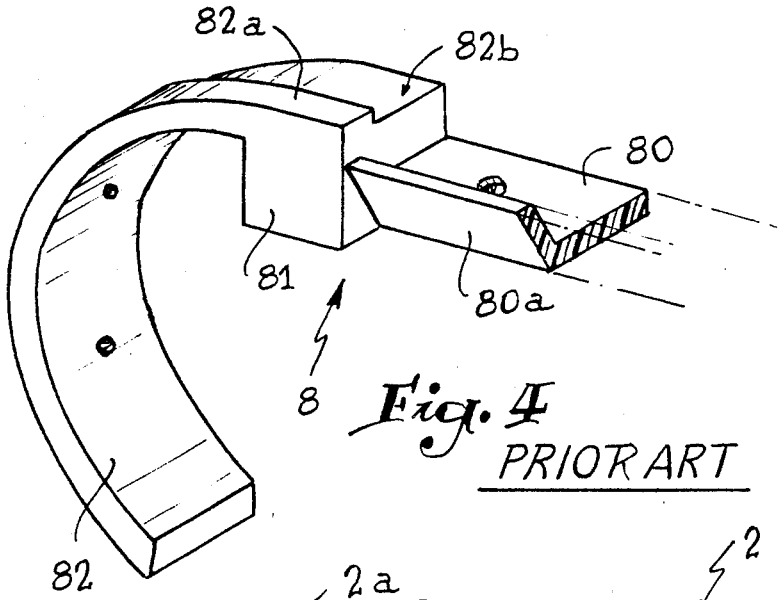
Fig. 4 PRIOR ART
FIG. 4 is a partial view in perspective of the sealing device of FIG. 3.
Figure 5:
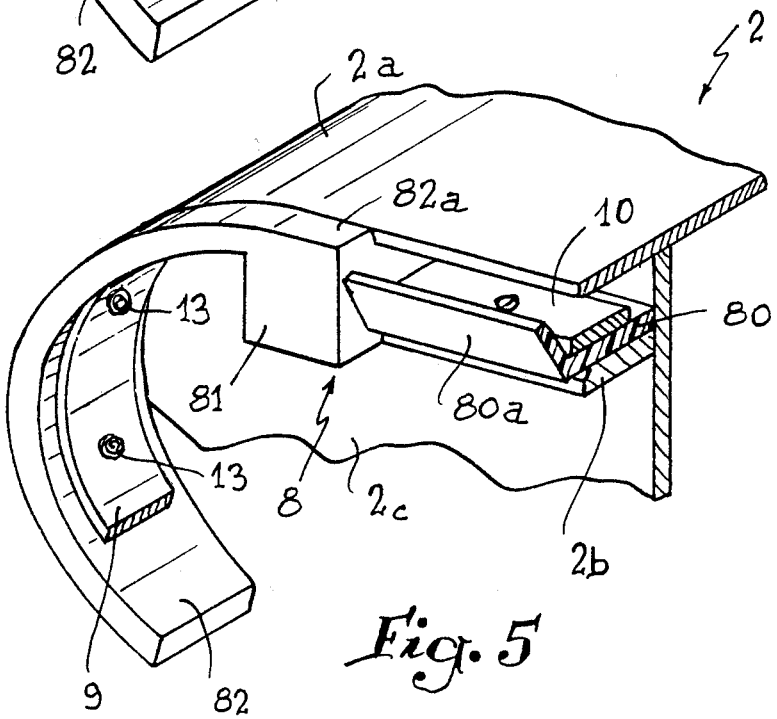
Fig. 5 PRIOR ART
FIG. 5 illustrates the assembly of the sealing device with respect to the leading face of a gate in accordance with the prior art technique.
Figure 7:
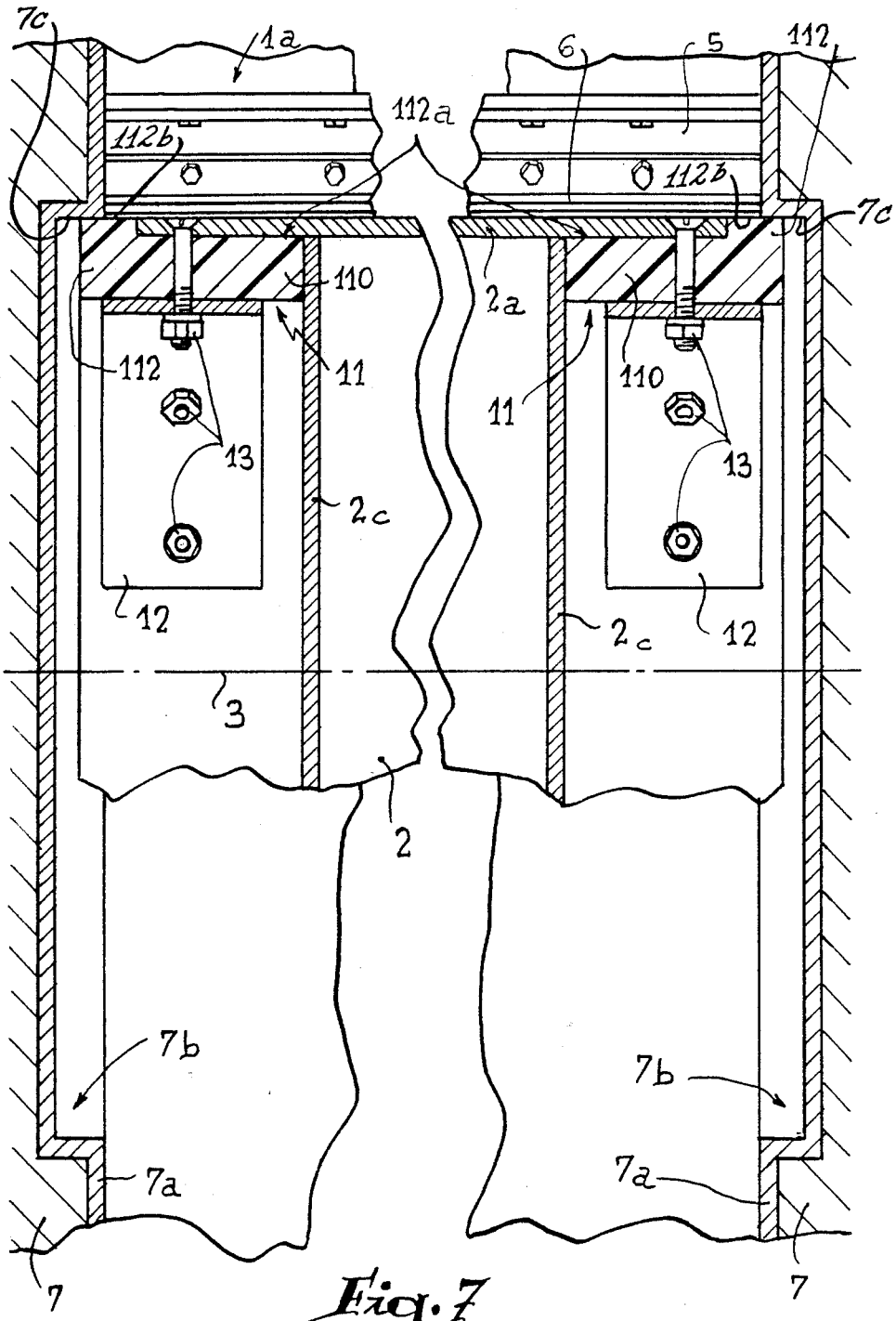
FIG. 7 is a view similar to that of FIG. 3, but showing the arrangement of the assembly according to the invention.

The gate 2 is mounted between two lock walls 7 which each constitute the vertical lateral walls of the sill 1. Each lock wall 7 is covered with a metal sheet 7*a*. On the two lateral or side faces of the gate 2 is mounted a sealing device 8 (FIG. 4) comprising a lip 80 presenting in cross section the shape of an open angle issuing from a block 81 from which extends a rounded rib 82 opposite the lip 80. The oblique flange 80*a* of the lip 80 presents a terminal edge lying in the same plane as the lateral flange 82*a* of the rib 82. The rib 82 includes a shoulder 82*b* which engages beneath the leading face 2*a* of the gate 2. As illustrated in FIG. 5, the remaining part of the periphery of the rib 82 lies in the plane of the leading face 2*a*. The rib 82 in question is assembled on the leading face 2*a* by a plate 9 of the same shape which fixes in sandwiched configuration the rib with respect to the leading face 2*a* by assembly bolts. It will be observed that the lip 80 is supported by a bar 2*b* which is perpendicular to a web 2*c* of the gate 2 oriented normally to the leading face 2*a*. A profile 10 allows the lip 80 to be fastened with respect to the bar 2*b*. It will be noted in FIG. 3 that the periphery of the rib 82 adjacent the shoulder 82*b* is flush with the lateral face of the leading face 2*a*, while its lateral edge 82*a* abuts against the metal sheet 7*a* of the lock wall 7.

It is unnecessary to describe such an arrangement in greater detail here, since it is well known in the relevant art.

According to the invention and in order to overcome the drawbacks set forth hereinabove, the arcuate rib 110 of the sealing device 11 according to the invention, replacing the sealing device 8 and which is provided with a lip 111 identical to lip 80 of the sealing device 8, projects beyond the end edge of the oblique flange 111*a* of the lip 11 (FIG. 6). Under these conditions, it is provided to arrange in the metal sheet 7*a* covering the lock wall 7 a cylindrical chamber 7*b* against the circular peripheral edges or walls 7*c* of which a portion 112*b* of the periphery 112 of the rib 110 abuts. This periphery 112 is also provided with a shoulder 112*a* in which the leading face 2*a* is seated, the periphery 112 being flush with the outside of the leading face, as illustrated in FIG. 8. There again, a plate 12 is provided, following the inner shape of the rib 110 and which lies beneath the leading face 2*a* so that the shoulder 112*a* is sandwiched between the leading face and the plate. Fastening bolts 12 ensure general assembly. In the embodiment according to the invention, the flat profile referenced 14 (FIG. 8) which corresponds to the profile 10 of the embodiment of FIGS. 1 to 5, extends by a rounded part 14*a* cooperating with the outer surface of the rib 110, beneath the leading face 2*a*. Bolts 15 thus enable the rib to be fastened with respect to the plate 12.

A lateral sealing device for a weir gate has thus been produced, which, during expansions or contractions thereof under the effect of heat or cold, continues to ensure perfect tightness, since the periphery 112 of the rib 110 of the sealing device 11 moves by sliding against the cylindrical peripheral wall of the chamber 7*b*, avoiding any defect in tightness since it is a sealing face parallel to the direction of displacement of the gate. This tightness is, of course, efficient whatever the angular position of the gate due to the cylindrical forms of the chamber 7*b* and of the periphery 112 which, of course, presents the same radius.

It must, moreover, be understood that the foregoing description has been given only by way of example and that it in no way limits the domain of the invention which would not be exceeded by replacing the details of execution described by any other equivalents.

What is claimed is:

1. In a sealing device for insuring the closure of a weir gate with respect to lock walls disposed on each side of the weir gate and wherein the weir gate includes a leading face and opposite side faces which are in opposing relationship to the lock walls and wherein the sealing device includes lip members which extend along each of the opposing side faces of the weir gate and extend outwardly therefrom toward the lock walls and wherein an arcuate rib member extends from each of the lip members forwardly thereof so that the leading surface of each arcuate rib is adjacent the leading face of the weir gate, the improvement comprising, an arcuate chamber recessed within each of the lock walls, said arcuate chambers being defined by arcuate peripheral side walls, each of said arcuate ribs having outer portions extending laterally outwardly from the leading surface of the weir gate so as to be partially seated within said chambers and in abutting engagement with said peripheral side walls of said chambers, whereby, said arcuate ribs may expand and contract within said chambers due to temperatures changes while remaining in abutting engagement against said peripheral side walls of said chambers.

2. The sealing device of claim 1, in which each of said arcuate ribs includes inner and outer surfaces, an arcuate recess formed in said outer surface of each arcuate rib, said arcuate recessed being remote from said outer portions of said ribs, said leading surface of the weir gate being seated within said arcuate recesses, and said outer portions of said ribs being substantially flush with said leading surface of the weir gate.

3. The sealing device of claim 2 including a plate means secured to each of said lip members, each of said plate means having a forward arcuate portion extending beyond said lip members so as to be in overlying engagement with said outer surface of said ribs, an arcuate plate means contacting said inner surface of said ribs and fastening means for securing said arcuate plate means to said forward portion of said plate means.

4. The sealing device of claim 3 in which said outer portions of said arcuate ribs extend laterally outwardly with respect to said lip members and with respect to said opposite side faces of the weir gate.

5. The sealing device of claim 1 wherein said leading surface of said weir gate extends partially over each of said arcuate ribs, said outer portions of said arcuate ribs being substantially flush with said leading surface of said weir gate.

* * * * *